United States Patent [19]

Sakuma et al.

[11] Patent Number: 4,766,944

[45] Date of Patent: Aug. 30, 1988

[54] PROCESS FOR CASTING FIBER-REINFORCED METAL BODY

[75] Inventors: Takeshi Sakuma, Tokyo; Nobuaki Takatori, Tokorozawa; Masuo Ebisawa, Kawagoe; Akio Hidaka, Sayama; Shigeo Kaiho, Oomiya; Akio Kawase, Ageo; Masahiro Inoue, Saitama, all of Japan

[73] Assignee: Honda Giken Kogyo Kabushiki Kaisha, Tokyo, Japan

[21] Appl. No.: 876,577

[22] Filed: Jun. 20, 1986

[30] Foreign Application Priority Data

| | | | |
|---|---|---|---|
| Jun. 21, 1985 | [JP] | Japan | 60-135499 |
| Jun. 21, 1985 | [JP] | Japan | 60-135500 |
| Jul. 4, 1985 | [JP] | Japan | 60-146999 |

[51] Int. Cl.[4] ..... B22D 17/00

[52] U.S. Cl. ..... 164/97; 164/305

[58] Field of Search ..... 164/97, 98, 113, 312, 164/313, 108–110, 305

[56] References Cited

U.S. PATENT DOCUMENTS

| | | | |
|---|---|---|---|
| 4,606,395 | 8/1986 | Ban et al. | 164/97 |

FOREIGN PATENT DOCUMENTS

| | | | |
|---|---|---|---|
| 47263 | 4/1981 | Japan | 164/305 |
| 71346 | 4/1983 | Japan | 164/97 |
| 93558 | 6/1983 | Japan | 164/98 |
| 66964 | 4/1984 | Japan | 164/98 |
| 66963 | 4/1984 | Japan | 164/305 |
| 97752 | 6/1984 | Japan | 164/98 |
| 101271 | 6/1984 | Japan | 164/97 |
| 136437 | 8/1984 | Japan | 164/97 |
| 59-206154 | 11/1984 | Japan | 164/97 |
| 15061 | 1/1985 | Japan | 164/97 |
| 83/02782 | 8/1983 | World Int. Prop. O. | 164/98 |
| 2168631 | 6/1986 | United Kingdom | 164/97 |

OTHER PUBLICATIONS

Metals Handbook, 8th Edition, vol. 5, p. 291, "Vents", 1970.

*Primary Examiner*—Nicholas P. Godici
*Assistant Examiner*—Samuel M. Heinrich
*Attorney, Agent, or Firm*—Armstrong, Nikaido, Marmelstein & Kubovcik

[57] ABSTRACT

A process for casing a fiber-reinforced metal body by placing a shaped fibrous article made of a reinforcing fiber into a cavity in a casting mold and filling a molten metal into the shaped fibrous article to solidify it, the process further including the steps of pouring the molten metal into the cavity from the lower portion thereof, while venting gas present within the cavity through a gas vent passage having a very small opening communicating with the upper portion of the cavity, and closing the gas vent passage and completely solidifying the molten metal under a higher pressure.

15 Claims, 12 Drawing Sheets

PROCESS FOR CASTING FIBER-REINFORCED METAL BODY

BACKGROUND OF THE INVENTION

1. Field of the Invention

The present invention relates to a process for casting a fiber-reinforced metal body and, more particularly, to such a casting process in which a shaped fibrous article made of a reinforcing fiber is placed into a cavity in a casting mold, and a molten metal is filled into the shaped fibrous article and solidified.

2. Description of the Prior Art

In casting such products, it is a conventional practice to disperse short fibers as reinforcing fibers into a molten metal and cast a metal product using that molten metal (see Japanese Patent Application Laid-open No. 206154/84).

However, the above procedure is accompanied by the problem that the short fibers are not uniformly dispersed in the product body thereby making it difficult to uniformly reinforce the entire body.

In addition, there is also known a fiber-reinforced cylinder block blank for engine use which is reinforced around its cylinder bore portion with a shaped fibrous article. In casting such cylinder block blank, a process has been adopted which comprises mounting a cylindrical shaped fibrous article on the outer peripheral surface of a cylinder bore shaping core disposed with its axis laid horizontally and then, pouring a molten metal into a cylinder block blank molding cavity in which the shaped fibrous article is located, from a position in the cavity near one open end of the shaped fibrous article and thereafter, completely solidifying the charged molten metal under a high pressure.

With the above process, however, problems are encountered: the flow of the molten metal runs axially from one open end of the shaped fibrous article toward the other open end, and for this reason, a gas such as air is liable to be confined at the other open end of the shaped fibrous article, resulting in the generation of voids in the product.

SUMMARY OF THE INVENTION

It is an object of the present invention to provide a process for casting a fiber reinforced metal body wherein by using a reinforcing fiber in the form of a molded article the reinforcing fiber can be disposed in uniform distribution entirely over the reinforcing parts of the resultant metal body, thereby allowing the obtained metal body to be reinforced evenly at its required portion.

It is another object of the present invention to provide such a process which enables the casting of a fiber-reinforced metal body having a high strength and a high quality and free from the generation of voids.

It is a further object of the present invention to provide such a process wherein in obtaining by casting a cylinder block blank which is fiber-reinforced around its cylinder bore, fiber reinforcement is effected reliably and a cylinder block blank free from voids and having a higher quality and a higher strength is produced.

To a accomplish the above objects, according to the present invention, there is provided a process for casting a fiber-reinforced metal body by placing a shaped fibrous article made of reinforcing fibers into a cavity in a casting mold and filling a molten metal into the shaped fibrous article to solidify it, comprising the steps of pouring the molten metal into the cavity from the lower portion thereof, while venting a gas within the cavity through a gas vent passage having a very small opening communicating with the upper portion of the cavity, and closing the gas vent passsage and completely solidifying the molten metal under a higher pressure.

In addition, according to the present invention, there is provided a process for casting a cylinder block blank as a fiber-reinforced metal body reinforced around its cylinder bore with a shaped fibrous article, comprising the steps of mounting a cylindrical shaped fibrous article on the outer peripheral surface of a cylinder bore shaping core disposed with its axis laid in a vertical direction, pouring a molten metal into a cylinder block blank molding cavity surrounding the shaped fibrous article from the lower portion thereof, while venting a gas within the cavity through a gas vent passage having a very small opening communicating with the upper portion of the cavity, and closing the gas vent passage, and completely solidifying the molten metal under a higher pressure.

Further, according to the present invention, there is provided a process for casting a fiber-reinforcing metal body wherein the shaped fibrous article is mounted on the core after it is previously heated to 200° C. or more.

With the above processes, the reinforcing fiber is used in the form of a molded article and hence, it can be disposed in uniform distribution over that entire portion of a resultant metal body which is required to be reinforced, thereby enabling the uniform fiber-reinforcement over the entire reinforcing process.

In addition, since the molten metal is poured into the cavity from the lower portion thereof and at the same time, the gas within the cavity is vented through the very small opening in the gas vent passage, a back pressure may be developed by the effect of throttling the very small opening and may act on the entire surface of the molten metal. As a result, the surface of the molten metal can be suppressed against waving and rise while being held as substantially horizontal surface, whereby the gas can be prevented from being trapped into the molten metal and can be efficiently vented.

Further, since the molten metal is solidified under application of higher pressure, it can be reliably filled into and integrated with the shaped fibrous article in the course of increasing the pressure and the metal structure of the matrix can be also densitified thereby making it possible to improve the strength.

Therefore, the employment of the above-described process enables the production of a shaped fibrous article free of any voids with a higher quality and a higher strength.

In addition, according to the above-described process, the cylindrical shaped fibrous article is mounted on the cylinder bore shaping core disposed with its axis laid in a vertical direction, and the molten metal is poured into the cylinder block blank molding cavity from the lower portion thereof, while at the same time, the gas within the cavity is vented through the very small opening of the gas vent passage. Therefore, a back pressure may be developed by the effect of throttling the very small opening and may act on the entire surface of the molten metal. As a result the surface of the molten metal can be suppressed to be substantially horizontal against waving and rise stably, whereby the gas can be prevented from being trapped into the molten metal and can be efficiently vented.

Thereafter, the molten metal is completely solidified under a higher pressure and hence, the molten metal can be reliably filled into the shaped fibrous article and the metal structure of the matrix can also be densified to improve the strength.

Accordingly, the use of the above-described process makes it possible to cast a fiber-reinforced cylinder block blank to have a higher strength which is reliably reinforced around its cylinder bore with the fiber and free from the generation of any voids.

In the above process, the previous heating of the shaped fibrous article to 200° C. or more enables the temperature of the molten metal to be maintained at a desired level around the shaped fibrous article, thereby avoiding the possibility that the heat of the molten metal may be absorbed by the shaped fibrous article to become undesirably solidified and deposited thereon.

The above and other objects, features and advantages of the invention will become apparent from reading the following detailed description taken in conjunction with the accompanying drawings.

BRIEF DESCRIPTION OF THE DRAWINGS

FIG. 1 being a perspective view thereof as viewed from above,

FIG. 2 being a sectional view taken along the line II—II in FIG. 1,

FIG. 3 being a sectional view taken along the line III—III in FIG. 2, and FIG. 4 being a perspective view as viewed from the lower side;

FIG. 6 being a front view in vertical section of the apparatus when a mold is opened, FIG. 7 being a front view in vertical section when the mold is closed, FIG. 8 being a sectional view taken along the line VIII—VIII in FIG. 7, and FIG. 9 being a sectional view taken along the line IX—IX in FIG. 8;

FIG. 10 being a perspective view as viewed from above, and

FIG. 11 being a sectional view taken along the line XI—XI in FIG. 10;

FIG. 15 being a front view of the details when a mold is closed, and

FIG. 16 being an enlarged sectional view taken along the line XVI—XVI in FIG. 15.

DESCRIPTION OF PREFERRED EMBODIMENTS

Figure 1:
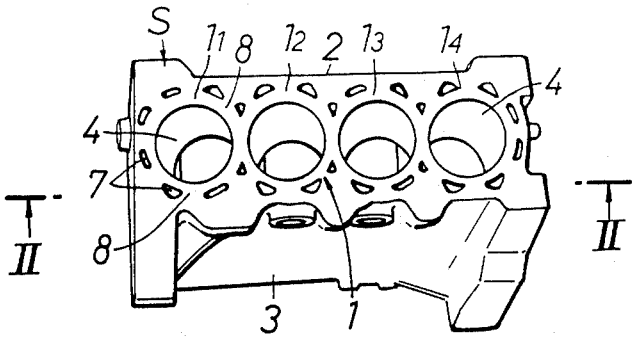
FIGS. 1 to 4 illustrate a siamese-type cylinder block.
Figure 2:
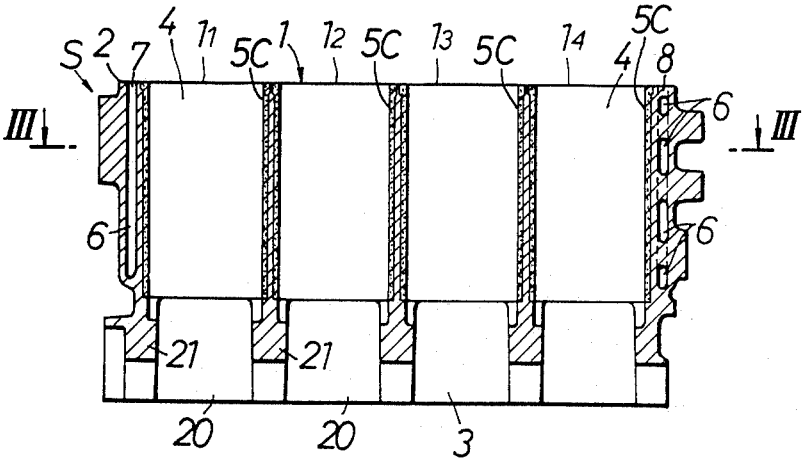
Figure 3:
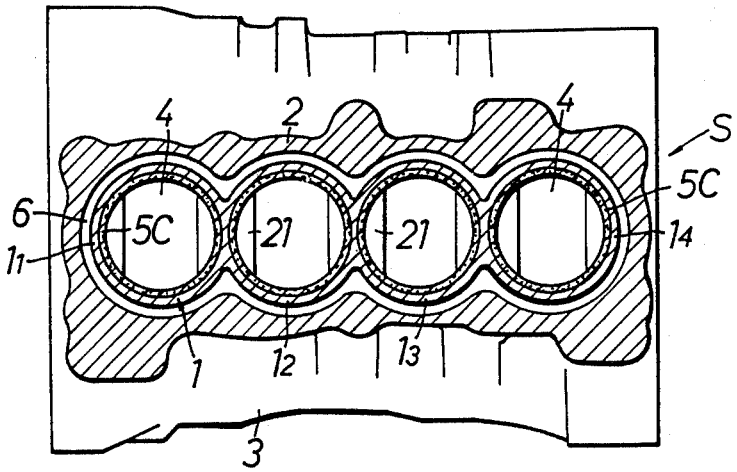

FIGS. 1 to 4 illustrate a siamese-type cylinder block S of a fiber-reinforced aluminum alloy produced from a blank as a fiber-reinforced metal body according to the present invention. The cylinder block S is comprised of a siamese-type cylinder barrel 1 consisting of a plurality of, e.g., four (in the illustrated embodiment) cylinder barrels $1_1$ to $1_4$ interconnected in series, an outer wall 2 surrounding the siamese-type cylinder barrel 1, and a crankcase 3 connected to the lower edge of the outer wall 2. A cylindrical shaped fibrous article 5 (FIG. 12) is embedded in a cylinder bore 4 in each of the cylinder barrels $1_1$ to $1_4$, and services to fiber-reinforce the inner peripheral wall of the cylinder bore 4. Therefore, the shaped fibrous article 5 and the aluminum alloy matrix constitute a fiber-reinforced composite cylinder 5C defining the cylinder bore 4.

Formed between the siamese-type cylinder barrel 1 and the outer wall 2 is a water jacket 6 to which the outer periphery of the siamese-type cylinder barrel 1 faces. At that end of the water jacket 6 which is close to a cylinder head, the siamese-type cylinder barrel 1 is partially connected with the outer wall 2 by a plurality of reinforcing deck portions 8, and the space between the adjacent reinforcing deck portions functions as a communication port 7. Thus, the cylinder block S is constituted into a closed deck type.

Figure 5:
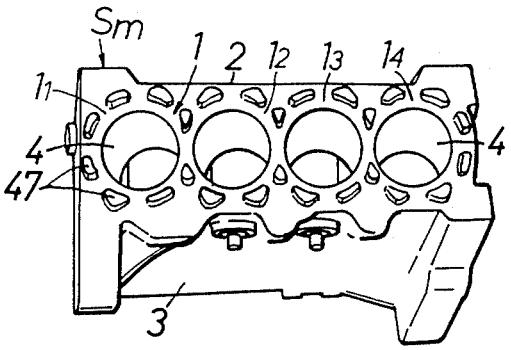
FIG. 5 is a perspective view of a cylinder block blank as viewed from the above.
Figure 4:
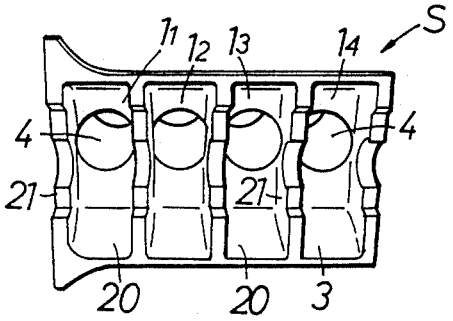

Referring to FIGS. 6 to 9, there is shown a casting apparatus employed in carrying out the present invention to cast a cylinder block blank Sm as shown in FIG. 5. The apparatus comprises a mold M as a casting mold. The mold M is constituted of a liftable upper die 9, first and second laterally (in FIGS. 6 and 7) split side dies $10_1$ and $10_2$ disposed below the upper die 9, third and fourth laterally (in FIG. 8) split side dies $10_3$ and $10_4$ and a lower die 11 on which the individual side dies $10_1$ to $10_4$ are slidably laid.

A mold clamping recess 12 is made on the underside of the upper die 9 to define a first cavity C1 for molding the siamese-type cylinder barrel 1 and the outer wall 2 in cooperation with the upper half of each of the side dies $10_1$ to $10_4$. A mold clamping projection 13 is provided on the upper surface of each of side dies $10_1$ to $10_4$ and adapted to be fitted into the recess 12.

Figure 8:
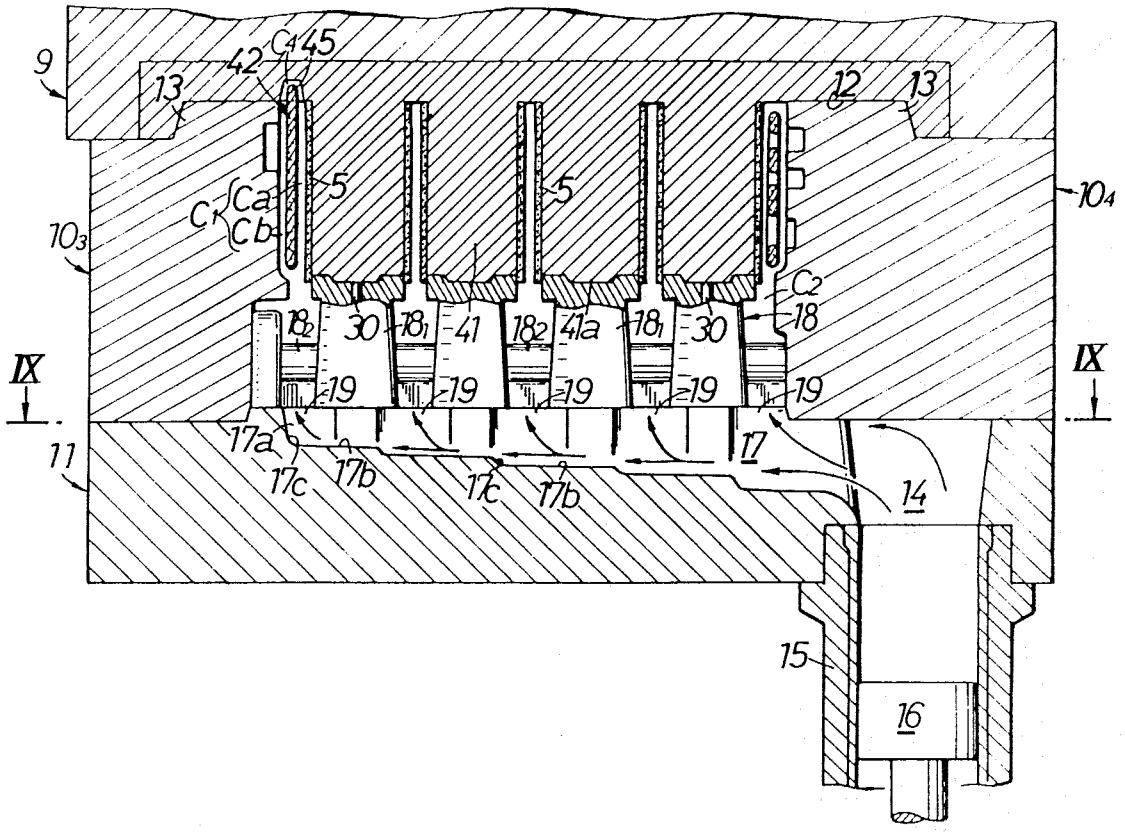
Figure 9:
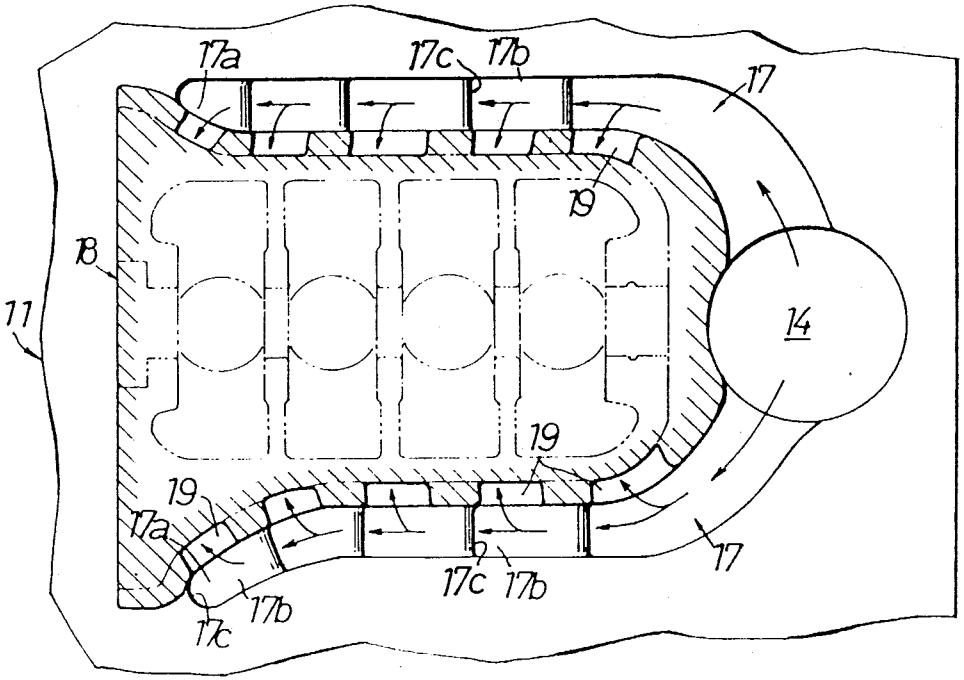

As shown in FIGS. 8 and 9, the lower die 11 is provided with a basin 14 for receiving a molten metal of aluminum alloy from a furnace (not shown), a pouring cylinder 15 communicating with the basin 14, a plunger 16 slidably fitted in the pouring cylinder 15, and a pair of runners 17 bifurcated from the basin 14 to extend along and substantially over the length of the first cavity C1. The lower die 11 also includes a molding block 18 which is protruded upwardly between both of the runners 17 and defines a second cavity C2 for molding the crankcase 3 in cooperation with the lower half of each the side dies $10_1$ to $10_4$. The cavity C2 communicates at its upper end with the first cavity C1 and at its opposite lower ends with both the runners 17 through a plurality of gates 19. The first and second cavities C1 and C2 constitute a cavity for molding a cylinder block blank.

The molding block 18 is comprised of four first taller semicolumner molding portions $18_1$ formed at predetermined distances, and second protruded molding portions $18_2$ located between the adjacent first molding portions $18_1$ and outside the opposite outermost first molding portions $18_1$. Each of the first molding portions $18_1$ is used to shape a space 20 (see FIGS. 2 and 4) within which a crankpin and a crankarm are to be rotated in a completed assembly, and each of the second molding portions $18_2$ is employed to mold a crank journal bearing holder 21 (see FIGS. 2 and 4). Each gate 19 is provided to correspond to each second molding portion $18_2$ and designed to permit the pouring of a molten metal into the larger volume portion of the second cavity C2 in an early stage.

The bottom surfaces of both the runners 17 are stepped in several ascending stairs and stepwise decrease in each sectional area from the basin 14 side toward runner extensions 17*a*. Each raised portion 17*c* connected to each stepped portion 17*b* is inclined at an angle to enable a molten metal to be smoothly guided into each the gate 19.

With the sectional area of the runner 17 reduced stepwise in this way toward the extension 17*a*, at its portion having a larger sectional area, a large amount of molten metal can be poured through the adjacent gate 19 into the second cavity C2 at a slower speed, and at a portion having a smaller sectional area, a smaller amount of molten metal can be poured through its adjacent gate 19 into the second cavity C2 at a faster speed. therefore, the molten metal is poured into the cavity C2 while rising in level substantially equally over the entirety thereof from opposite lower ends of the cavity C2, thus enabling the molten metal pouring operation to be effectively conducted, leading to an improved casting efficiency.

Figure 6:
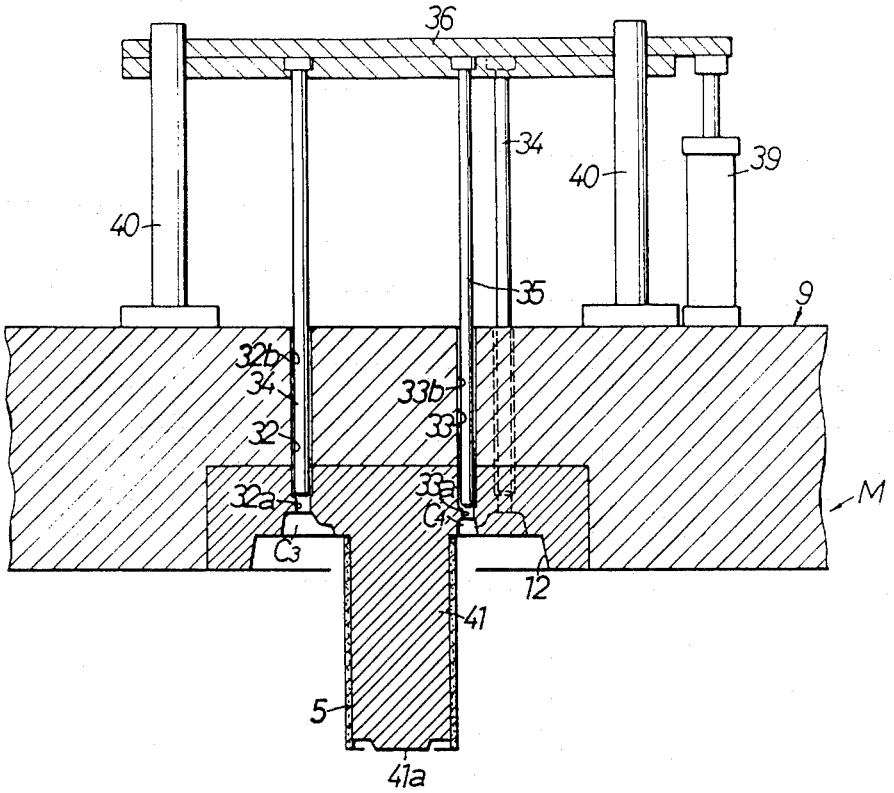
FIGS. 6 to 9 illustrate one example of a casting apparatus.
Figure 6:
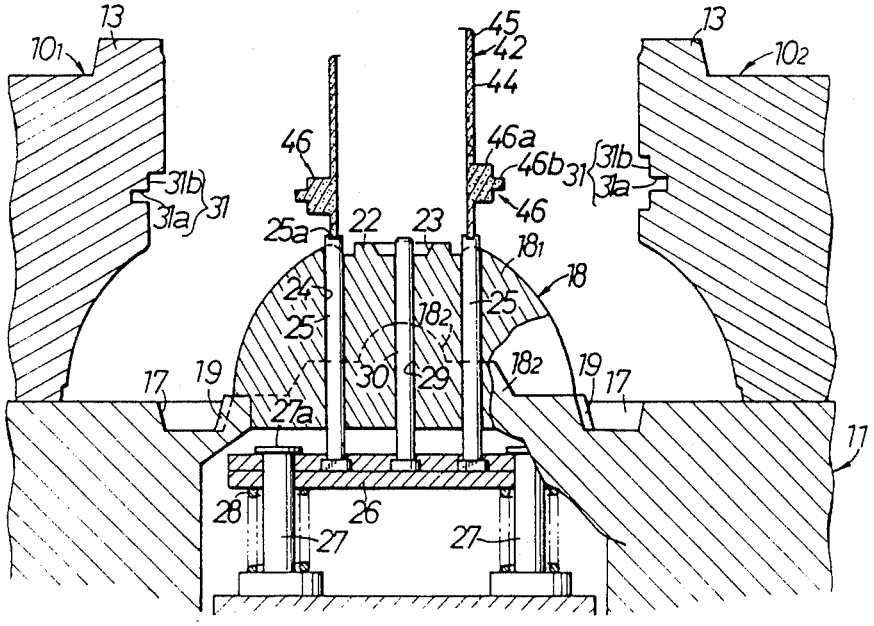
Figure 7:
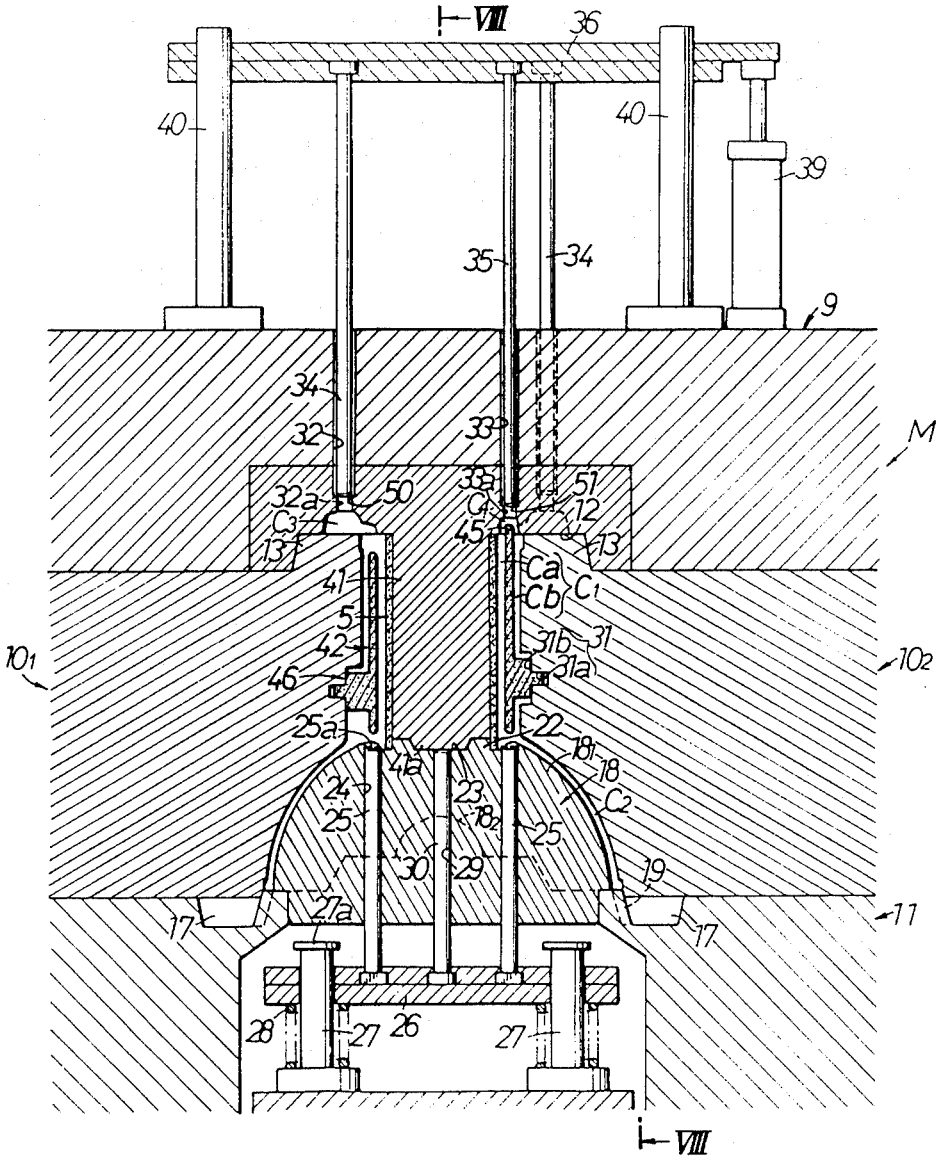

As shown in FIGS. 6 and 7, a locating projection 22, on which the lower end of the shaped fibrous article F is fitted, is provided on the top surface of each first molding portion $18_1$, and a recess 23 is formed at the center of the locating projection 22. A through hole 24 is made, on each the opposite sides of the locating projection 22, in and through each of the two first molding portions $18_1$ located on the opposite ends, so that a pair of temporary locating pins 25 may be slidably fitted in the through holes 24 respectively. The temporary locating pins 25 are used to temporary locate a water jacket shaping sand core which will be described hereinafter. The lower ends of the temporarily locating pins 25 are fixedly mounted on a mounting plate 26 disposed below the molding block 18. Two support rods 27 are inserted through the mounting plate 26, and a coil spring 29 is provided in compression between the lower portion of each support rod 27 and the lower surface at the mounting plate 26. At the time of opening of the mold, the mounting plate 26 moves up due to the resilient force of each the coil springs 28 until it abuts against the stopper 27*a* on the fore end of each the support rods 27, thereby allowing the fore end of each the temporary locating pins 25 to protrude from the top surface of the first molding portion $18_1$. A recess 25*a* is made at the fore end surface of each the temporary locating pins 25 for engagement by the lower edge of the sand core.

A through hole 29 is made in and through each of the two first molding portions $18_1$ located on the opposite ends at a bisected place between both of the through holes 24, and an operating pin 30 fixed at its lower end on the mounting plate 26 is slidably fitted in the through hole 29. When opening the mold, the fore end of the operating or actuating pin 30 protrudes into the recess 23, whereas when closing the mold, the fore end is pushed down by a cylinder bore shaping core which will be described hereinafter, thereby retracting both the temporary locating pins 25 from the top surfaces of the first molding portions $18_1$.

A core bedding recess 31 for really locating the sand core is provided at two places, in the central portions of those walls of the first and second side dies $10_1$ and $10_2$ which define the first cavity C1. Each of the core bedding recesses 31 consists of an engaging bore 31*a* for providing the positioning of the sand core, and a clamp surface 31*b* formed around the outer periphery of the opening of the engaging bore 31*a* for clamping the sand core.

Made in the upper die 9 are a plurality of third cavities C3 opened into the first cavity C1 to permit any overflow of a molten metal and a plurality of fourth cavities C4 for shaping the communication holes 7.

Gas vent passages 32 and 33 are also made in the upper die 9. The gas vent passage 32 or 33 comprises a smaller diameter portion 32*a* or 33*a* communicating with the third or fourth cavity C3 or C4 and a larger diameter portion 32*b* or 33*b* connected to the smaller diameter portion 32*a* or 33*a*.

Closing pins 34 and 35 are loosely inserted into the larger diameter portions 32*b* and 33*b*, respectively. The upper ends of the closing pins 34 and 35 are fixedly mounted on a mounting plate 36 disposed above the upper die 9, and the lower ends of the closing pins are adapted to be fitted into the smaller diameter portions 32*a* and 33*a* to close the gas vent passage 32 and 33, respectively.

A hydraulic cylinder 39 is interposed between the upper die 9 and the mounting plate 36 and is interposed between the upper die 9 and the mounting plate 36 and is operable to move the mounting plate 36 upwardly or downwardly, thereby causing the individual closing pins 34 and 35 to close the corresponding smaller diameter portions 32*a* and 33*a*. It is to be noted that the reference numeral 40 designates a rod for guiding the mounting plate 36.

A columnar cylinder bore shaping core 41 is mounted on the top surface of the clamping recess 12 in the upper die 9 to depend therefrom with its axis oriented in the vertical direction and to correspond to each of the cylinder barrels $1_1$ to $1_4$, and is provided at its lower end surface with a raised or protruding portion 41*a* which fits in the recess 23 at the top surface of the first molding portion $18_1$.

Figure 10:
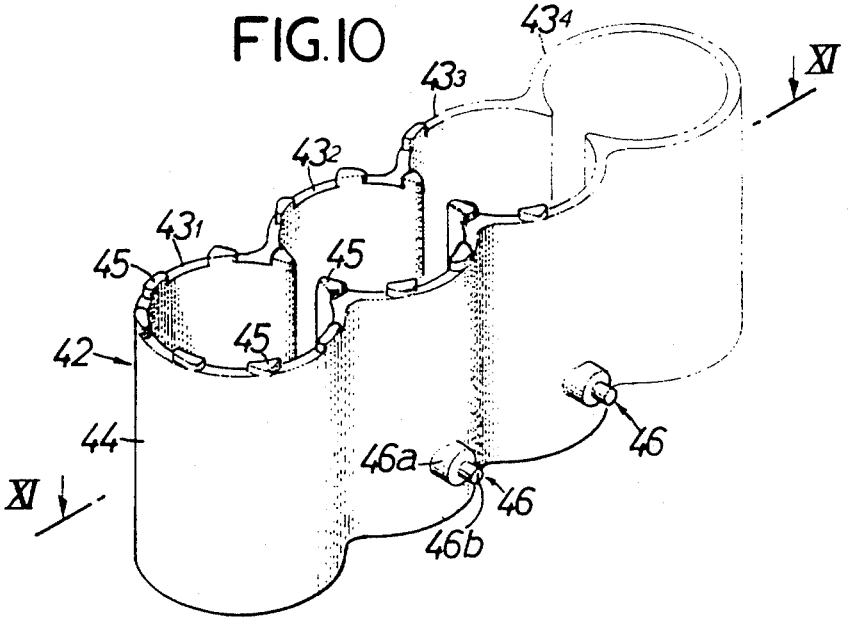
FIGS. 10 and 11 illustrate a water jacket shaping core.
Figure 11:
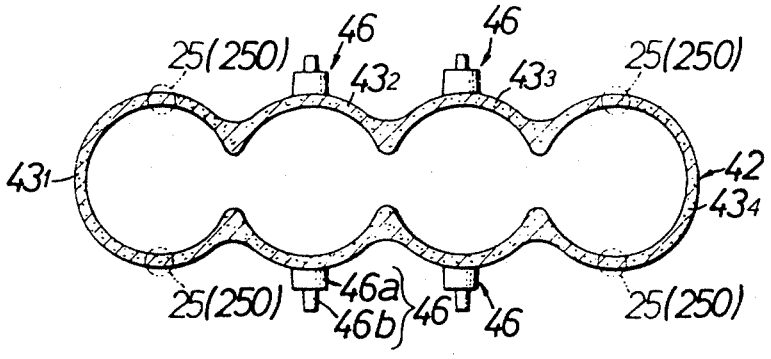

FIGS. 10 and 11 illustrate the water jacket shaping sand core 42 which is constituted of a core body 44 including four cylindrical portions $43_1$ and $43_4$ corresponding to the four cylinder barrels $1_1$ to $1_4$ of the cylinder block S, with peripheral interconnecting walls of the adjacent cylindrical portions being eliminated, a plurality of projections 45 formed on the one end surface of the core body 44 to form the deck portions and the communication ports 7 for permitting the communication of the water jacket 6 with a water jacket in a cylinder head, and core prints 46 respectively provided in protrusion on the opposite outer side surfaces of the two middle cylindrical portions $43_2$ and $43_3$. Each of the core prints 46 is comprised of a larger diameter portion 46*a* integral with the core body 44 and a smaller diameter portion 46*b* projected from the end surface of the larger diameter portion 46*a*.

Figure 12:
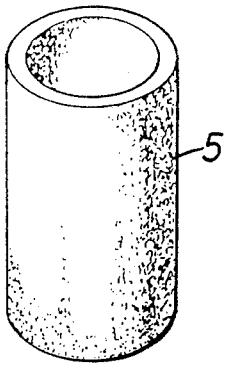
FIG. 12 is a perspective view of a shaped fibrous article as viewed from above.

FIG. 12 illustrates a cylindrical shaped fibrous article 5 made from mixed carbon and alumina fibers. The shaped fibrous article has an outside diameter of 89 mm, and inside diameter of 78 mm, a height of 152 mm and a bulk density of 0.3 g/cm$^2$. Such shaped fibrous article 5 has been molded in a suction deposition molding manner by mixing carbon fiber (short fiber) having an average diameter of 18 m and an average length of 0.8 mm with alumina fiber (short fiber having an average diameter of 3 to 4 m and an average length of 0.5 mm at a proportion of 1:3 and adding a silica sol as an inorganic binder to the mixed short fibers. In this case, it is possible to employ an alumina sol alone or a mixture of silica and alumina sols, instead of the silica sol.

The above suction deposition molding manner is described to indicate a procedure in which a gas-permeable cylindrical die hermetically closed at its opposite ends is placed in a pot containing the mixture of the aforesaid mixed short fibers and the silica sol therein, and a suction is applied to the interior of the cylindrical die to adsorb the mixture onto the outer peripheral surface of the cylindrical die.

The shaped fibrous article 5 molded according to the above procedure is placed in use after it has been subjected to drying and firing steps after released from the mold.

Description will now be made of the operation of casting a cylinder block blank Sm in the casting apparatus using the above-mentioned shaped fibrous article 5.

First, as shown in FIG. 6, the upper die 9 is moved up and the opposed side dies $\mathbf{10}_1$ and $\mathbf{10}_2$; and $\mathbf{10}_3$ and $\mathbf{10}_4$ are moved away from each other to open the mold. The hydraulic cylinder 39 on the upper die 9 is operated to lift the individual closing pins 34 and 35 through the mounting plate 36, so that the lower ends of the closing pins are located in the vicinity of the upper openings of the smaller diameter portions 32*a* and 33*a* to throttle the opening degree of the upper openings, thus defining very small openings 50 and 51. Further, the plunger 16 within the pouring cylinder 15 is moved down.

The shaped fibrous article 5 previously heated to a temperature of approximately 300° C. is placed in each of the cores 41, so that the end surface at the upper opening of the shaped fibrous article 5 is allowed to abut against the ceiling surface of the recess 12.

As shown in FIGS. 6 and 11, the lower ends of the outermost opposite cylindrical portions $\mathbf{43}_1$ and $\mathbf{43}_4$ of the sand core 42 are brought into engagement with the recesses 25*a* of the temporary locating pins 25 protruding above the top surfaces of the first molding portions $\mathbf{18}_1$ on the opposite ends in the lower die 11, thereby temporarily locating the sand core 42.

As shown in FIG. 7, the side dies $\mathbf{10}_1$ and $\mathbf{10}_2$ are moved a predetermined distance toward each other to bring each core bedding recess 31 into engagement with each core print 46, thus effecting the real locating of the sand core 42. More specifically, the smaller diameter portion 46*b* of each core print 46 is fitted into the engaging bore 31*a* in each core bedding recess 31 to position the sand core 42, while that end surface of each larger diameter portion 46*a* which is parallel to the direction of the array of cylinder barrels is mated with each clamp surface 31*b* to clamp the sand core 42 by clamp surfaces 31*b*. The side dies $\mathbf{10}_3$ and $\mathbf{10}_4$ are also moved in a similar manner.

Then, the upper die 9 is moved down, and each shaped fibrous article 5 is inserted into each of the cylindrical portions $\mathbf{43}_1$ to $\mathbf{43}_4$ of the sand core 42, so that the lower end of the shaped fibrous article 5 is fitted over the locating projection 22 and the raised or protruded portion 41*a* of the core 41 is fitted into the recess 23 at the top surface of the first molding portion $\mathbf{18}_1$. This fitting between the raised portion and the recess causes the operation or actuating pin 30 to be forced down, whereby each temporary locating pin 25 is moved down and retracted from the top surface of the first molding portion $\mathbf{18}_1$. In addition, each projection 45 of the sand core 42 is loosely inserted into each fourth cavity C4 and further, the clamping recess 12 of the upper die 9 is fitted with the clamping projection 13 of each the side dies $\mathbf{10}_1$ to $\mathbf{10}_4$, thus achieving the mold clamping.

The first cavity C1 is sectioned into a cylinder barrel molding portion Ca between the core 41 and sand core 42, and an outer wall molding portion Cb between the sand core 42 and each the side dies $\mathbf{10}_1$ to $\mathbf{10}_4$.

A molten metal of aluminum alloy (JIS ADC12) at 730° to 740° C. is supplied from a furnace into the basin 14 of the lower die 11 and then, the plunger 16 is moved up at a velocity of 0.08 to 0.3 m/sec to force the molten metal through the runners 17 and pour it through the gates 19 into the second cavity C2 and the first cavity C1 from the opposite lower portions of the second cavity C2. A gas such as air within both the cavities C1 and C2 is forced up by the molten metal and vented upwardly from the upper die 9 via the gas vent passages 32 and 33 communicating with the third and fourth cavities C3 and C4.

In this case, the upward movement of the plunger 16 causes the molten metal to flow through both runners 17 and the gates 19 into the second cavity C2 substantially equally over the entire length from the opposite lower ends thereof, because the bottom surfaces of the both runners 17 are stepped in several ascending stairs from the basin 14 toward the extensions 17*a* so that the sectional area of each the runners 17 is reduced stepwise toward the runner extension 17*a*.

Figure 13:
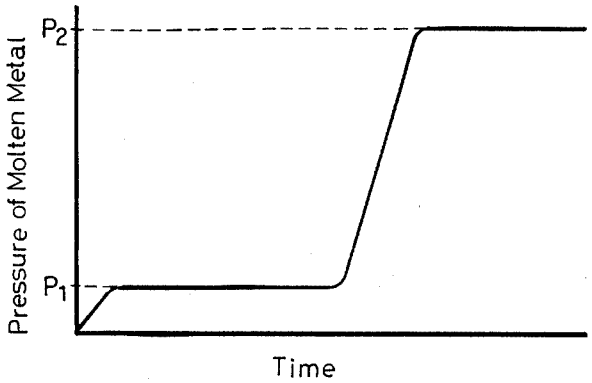
FIG. 13 is a graph illustrating a relationship between the pressure of a molten metal and the passage of time.

In addition, a back pressure is developed within the first and second cavities C1 and C2 by the throttling effect exhibited by the very small openings 50 and 51 in the respective gas vent passages 32 and 33 and equally acts on the entire molten metal surface. Consequently, the molten metal surface raises substantially horizontally while being suppressed against waving, whereby gas is prevented from being trapped into the molten metal and also, the venting of the gas is effected with a good efficiency, thus avoiding the generation of any voids. Due to the above-mentioned back pressure, the pressure of molten metal poured in the first and second cavities C1 and C2 become a level p1 exceeding an atmospheric pressure, e.g., 2 to 5 kg/cm$^2$, as shown in FIG. 13.

Further, because the shaped fibrous article 5 is previously heated to the above-described temperature, the maintaining of the temperature is assured to avoid the solidification and deposition of the molten metal on the shaped fibrous article 5.

After the third and fourth cavities C3 and C4 have been fully filled with the molten metal, the hydraulic cylinder 39 on the upper die 9 is operated to move down the mounting plate 36, so that the closing pins 34 and 35 are fitted into the smaller diameter portions 32*a* and 33*a* to close the gas vent passages 32 and 33, respectively.

Then, the plunger 16 is raised at a velocity of 0.14 to 0.18 m/sec to hold the molten metal under a high pressure p2 exceeding the above-mentioned pressure p1, i.e., under a pressure of 400 kg/cm$^2$ and completely solidify it, thereby densifying the structure of aluminum alloy which can have an improved strength. In the course of increasing the pressure applied to the molten metal, the molten metal can be filled into the shaped fibrous article 5 reliably at a pressure of 5 to 20 kg/cm$^2$ on the molten metal. In this way, the filling pressure of molten metal is at a low level and hence, the shaped fibrous article 5 cannot be broken by the molten metal during the filling process.

Because sand core 42 is clamped in an accurate position by the both side dies $10_1$ and $10_2$ through the individual core prints 46 of the sand core, it would not float up during pouring the molten metal into the first cavity C1 and during pressurizing the molten metal charged within the cavity C1. In addition, since the end surface of the larger diameter diameter portion 46*a* of each core print 46 abuts against the clamp surface 31*b* of the core bedding recess 31 in each of the side dies $10_1$ and $10_2$, when the sand core shows a tendency to be expanded, the force acting on said core to deform it is supported by each clamp surface 31*b* so that deformation of the sand core 42 can be prevented, thus providing a siamese-type cylinder barrel 1 having a uniform thickness achieved around each cylinder bore 4.

After the solidification of the molten metal has been completed, the mold is opened to give a cylinder block blank Sm as shown in FIG. 5.

The thus obtained cylinder block blank Sm is subjected to grinding work to remove the projected portions 47 each formed by the fourth cavity C4. Consequently, the communication ports 7 and the reinforcing deck portions 8 are formed. In addition, by extracting the sand there is achieved the water jacket 6. Further, the inner peripheral surface of each cylinder bore 4 is subjected to a working into a true circle as well as to other required workings thereby giving a cylinder block S as shown in FIGS. 1 to 4.

Figure 14:
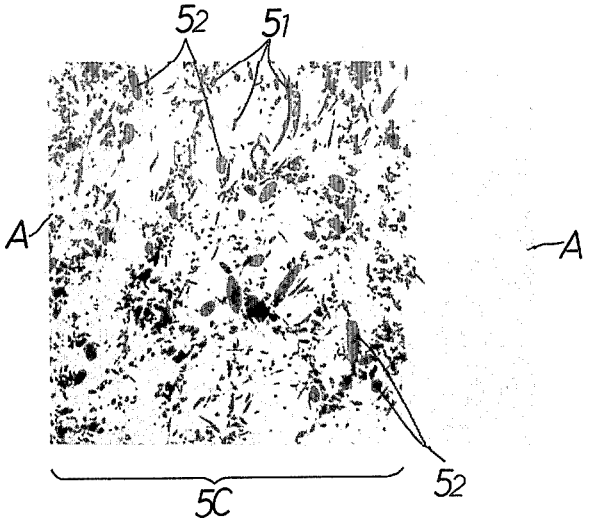
FIG. 14 is a microphotograph showing the metal structure at a fiber-reinforced composite cylinder and a portion of only the matrix.

FIG. 14 is a microphotograph (100 times) of a metal structure which has been shown at the fiber-reinforced composite cylinder 5C consisting of the matrix of the shaped fibrous article 5 and the aluminum alloy A and the portion consisting of the aluminum alloy A alone, wherein a small point and a linear portion $5_1$ correspond to the aluminum fiber, and a gray, oval portion $5_2$ corresponds to the carbon fiber.

It is apparent from FIG. 14 that the aluminum alloy A is substantially completely filled in the fiber molded article 5.

It should be noted that in the above-described process, if the previous heating temperature of the shaped fibrous article 5 is less than 200° C., the heat of the molten metal may be absorbed by the shaped fiber article 5 and consequently, the molten metal may be undesirably solidified and deposited on the shaped fibrous article 5. In some cases, however, the shaped fibrous article 5 may be employed at ambient temperature.

Figure 15:
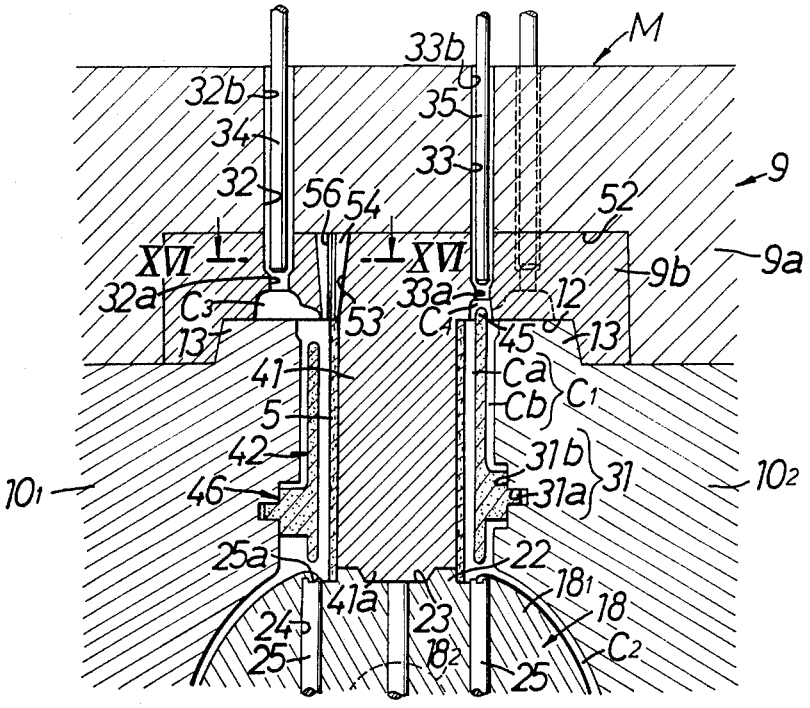
FIGS. 15 and 16 illustrate another example of the casting apparatus.
Figure 16:
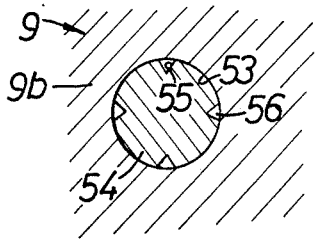

FIGS. 15 and 16 illustrate a modification of a gas vent passage. In this modification, the upper die 9 is comprised of a body 9*a* and a cavity-defining member 9*b* fitted in a downwardly facing recess 52 formed in the body 9*a*. A plurality of mounting holes 53 are made in the cavity-defining member 9*b* and opened into the first cavity C1 and to the ceiling surface of the downwardly facing recess 52. Each of the mounting holes 53 is tapered from its upper end toward its lower end. A tapered pin 54 is fitted in each mounting hole 53. A gas vent passage 56 in the form of a very small hole is defined by the inner surface of each of a plurality of V-shaped grooves made in the outer peripheral surface of the pin 54 in the directions of generating lines of the pin and by the inner peripheral surface of each mounting hole 53. In this case, the depth of each groove 55 is set at 0.1 to 0.5 mm.

The gas vent passage 56 communicates with the larger diameter portions 32*b* and 33*b* of the other gas vent passages 32 and 33 through a very small clearance formed between the body 9*a* and cavity-defining member 9*b*.

The closing of the gas vent passage 56 is effected by the solidification of the molten metal which has entered such gas vent passage 56. In this case, the molten metal is immediately solidified by being cooled by the upper die 9 when it has entered the gas vent passage 56 by only a short distance, and the solidified metal is released from the mold along with the cylinder block blank Sm when the letter is released from the mold.

Figure 17:
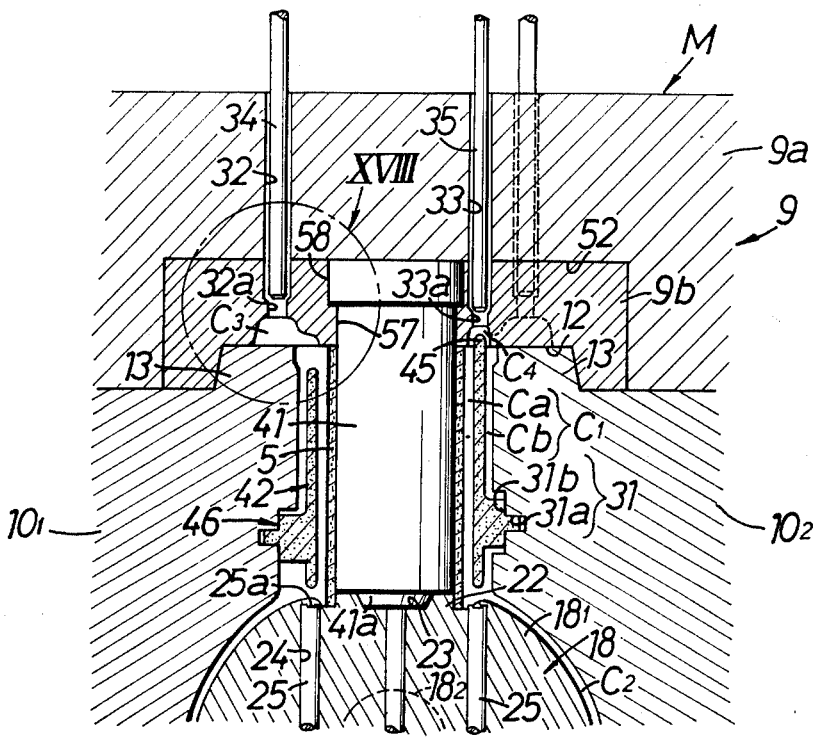
FIGS. 17 and 18 illustrate a further example of the casting apparatus, FIG. 17 being a front view in vertical section of the details when a mold is closed, and FIG. 18 being an enlarged view of the portion surrounded by a circle indicated by an arrow XVIII in FIG. 17.
Figure 18:
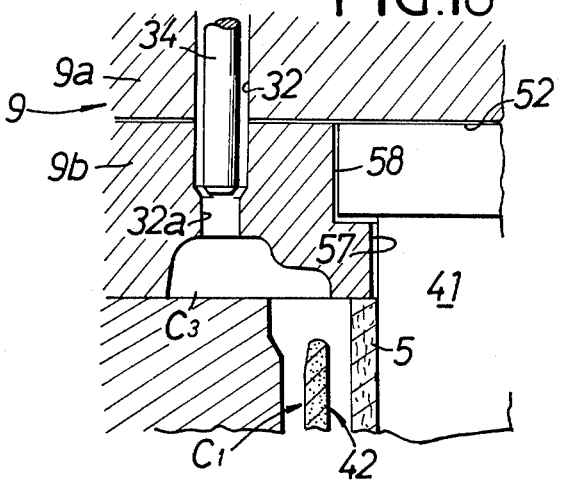

FIGS. 17 and 18 illustrate another modification of a gas vent passage. In this case, the upper die 9 is comprised of, as in the above first modification, the body 9*a* and the cavity-defining member 9*b* fitter in the downwardly faced recess 52 in the body 9.

Four stepped through holes 57 are made in the cavity-defining member 9*b*, and the upper end of the cylinder bore shaping core 41 is fitted into each through hole 57.

In this modification, a gas vent passage 58 is defined between the through hole 57 and the core 41 and between the body 9*a* and the cavity-defining member 9*b* and thus, is provided by a very small clearance of 0.1 to 0.5 mm between mating surfaces of these components.

The closing of the gas vent passage 58 is effected by the solidification of the molten metal which has entered the passage 58. The solidified metal is released from the mold along with the cylinder block blank Sm when the latter is released from the mold.

It is to be understood that in the modifications of FIGS. 15 and 17, the other gas vent passages 32 and 33 are also employed, but in some cases, the venting of the gas may be effected by only the gas vent passages 56 and 58.

In addition, the shaped fibrous article 5 may be molded from one kind of reinforcing fiber alone. For the matrix, cast iron, copper, magnesium alloy, etc. may be eployed other than the above-mentioned aluminum alloy.

What is claimed is:

1. A process for casting a fiber-reinforced metal body by placing a shaped fibrous article made of a reinforcing fiber into a cavity of a casting mold, charging a molten metal into said cavity to fill the shaped fibrous article with the molten metal and solidifying the metal, the process comprising the steps of:

pouring the molten metal into the cavity from a lower portion of the cavity while venting gas present in said cavity through a gas vent passage having a small opening opened to an upper portion of said cavity;

throttling said small opening of said gas vent passage during charging of the molten metal into the cavity so as to apply a back pressure to a surface of the molten metal being charged into the cavity and thereby suppress waving of the molten metal surface;

closing said gas vent passage; and completely solidifying the molten metal under application of a higher pressure.

2. A process according to claim 1, wherein said gas vent passage comprises a smaller diameter portion and a larger diameter portion connected to said smaller diameter portion, and said small opening is defined by the smaller diameter portion having an opening degree thereof throttled adjustably by a closing pin which is loosely inserted into said larger diameter portion, said gas vent passage being closed by fitting said closing pin into said smaller diameter portion.

3. A process according to claim 1, wherein said gas vent passage is a small hole defined between an inner peripheral surface of a mounting hole provided in said casting mold and an inner surface of a groove formed in the outer surface of a pin fitted in said mounting hole, said vent passage being closed by solidification of said molten metal which has entered said gas vent passage.

4. A process according to claim 1, wherein said gas vent passage is a small clearance defined between mating surfaces of components constituting said casting mold and said gas vent passage is closed by solidification of said molten metal which has entered said gas vent passage.

5. A process according to claim 1, wherein said fibrous molded article is formed of mixed short fibers containing carbon fibers and alumina fibers and bonded with an inorganic binder.

6. A process according to claim 1, wherein said molten metal is an aluminum alloy.

7. A process according to claim 1, wherein said fiber-reinforced metal body is a cylinder block blank reinforced around a cylinder bore portion thereof by a cylindrically shaped fibrous article.

8. A process for casting a fiber-reinforced metal body which is in the form of a cylinder block blank for use with an engine, said blank being reinforced by a shaped fibrous article around a cylinder bore portion thereof, the process comprising the steps of:

locating a cylindrically shaped fibrous article in a cavity of a cylinder block blank casting mold so as to assume a position around an outer peripheral surface of a cylinder bore shaping core disposed in said cavity with an axis thereof directed in a vertical direction;

pouring a molten metal into the cavity from a lower portion of the cavity while venting gas present in said cavity through a gas vent passage having a small opening opened to an upper portion of said cavity;

throttling said small opening of said gas vent passage during charging of the molten metal into the cavity so as to apply a back pressure to a surface of the molten metal being charged into the cavity and thereby suppress waving of the molten metal surface;

closing said gas vent passage; and completely solidifying said molten metal under application of a higher pressure.

9. A process according to claim 1, wherein said gas vent passage comprises a smaller diameter portion and a larger diameter portion connected to said smaller diameter portion, and said small opening is defined by the smaller diameter portion having an opening degree thereof throttled adjustably by a closing pin which is loosely inserted into said larger diameter portion, said gas vent passage being closed by fitting said closing pin into said smaller diameter portion.

10. A process according to claim 1, wherein said gas vent passage is a small hole defined between an inner peripheral surface of a mounting hole provided in said casting mold and an inner surface of a groove formed in the outer surface of a pin fitted in said mounting hole, said vent passage being closed by solidification of said molten metal which has entered said gas vent passage.

11. A process according to claim 1, wherein said gas vent passage is a small clearance defined between mating surfaces of components constituting said casting mold and said gas vent passage is closed by solidification of said molten metal which has entered said gas vent passage.

12. A process according to claim 1, wherein said shaped fibrous article is mounted on said core at ambient temperature.

13. A process according to claim 1, wherein said shaped fibrous article is mounted on said core after being previously heated to a temperature of at least 200° C.

14. A process accordng to claim 1, wherein said shaped fibrous article is formed of mixed short fibers containing carbon fibers and alumina fibers and bonded with an inorganic binder.

15. A process according to claim 1 wherein said molten metal is an aluminum alloy.

* * * * *